US005783275A

United States Patent [19]

Mück et al.

[11] Patent Number: 5,783,275

[45] Date of Patent: Jul. 21, 1998

[54] ANTIFALSIFICATION PAPER

[75] Inventors: Hajo Mück, Dachau; Siegfried Harms, Unterschleissheim, both of Germany

[73] Assignee: Giesecke & Devrient GmbH, Munchen, Germany

[21] Appl. No.: 501,875

[22] Filed: Jul. 13, 1995

Related U.S. Application Data

[63] Continuation of Ser. No. 235,535, Apr. 29, 1994, abandoned.

[30] Foreign Application Priority Data

May 1, 1993 [DE] Germany ..... 43 14 380.6

[51] Int. Cl.[6] ..... B42D 15/00

[52] U.S. Cl. ..... 428/138; 428/131; 428/134; 428/195; 428/916; 283/94; 162/104; 162/105; 162/109; 162/124

[58] Field of Search ..... 428/131, 134, 428/138, 195, 916; 283/94; 162/104, 105, 109, 124

[56] References Cited

U.S. PATENT DOCUMENTS 4,462,867 7/1984 Fuller .
4,942,093 7/1990 Melling et al. .
5,093,184 3/1992 Edwards .

FOREIGN PATENT DOCUMENTS 0 070 172 1/1983 European Pat. Off. .
0 400 902 12/1990 European Pat. Off. .

*Primary Examiner*—Jenna Davis
*Assistant Examiner*—Elizabeth M. Cole
*Attorney, Agent, or Firm*—Bacon & Thomas

[57] ABSTRACT

An antifalsification paper is described having an embedded safeguarding thread which is embedded in the paper so as to be freely accessible in some areas. The safeguarding thread has a width greater than 2 mm. The antifalsification paper comprises at least two paper layers produced on separate paper machines. The safeguarding thread is embedded in the first paper layer which has openings or recesses in its surface through which the thread is partly accessible on both sides. This first paper layer is covered with at least one second paper layer and firmly connected therewith, the second paper layer having a thickness of 10 to 50%, preferably 20%, of the total thickness of the antifalsification paper. The use of particularly wide safeguarding threads and the resulting possibility of equipping the threads with certain optical effects can improve the resistance to forgery of the antifalsification paper provided therewith.

4 Claims, 6 Drawing Sheets

ANTIFALSIFICATION PAPER

This application is a continuation of application Ser. No. 08/235,535, filed Apr. 29, 1994 now abandoned.

FIELD OF THE INVENTION

The present invention relates to an antifalsification paper having an embedded safeguarding band which is embedded in the paper so as to be freely accessible at least in part, and to a method for producing it.

DESCRIPTION OF PRIOR ART

For antifalsification papers such as bank notes, papers of value, documents, identity cards, etc., it is known to embed security elements in the form of threads, bands or the like as security features. These threads or bands are usually incorporated in the paper during production of the paper. With cylinder mold machines the thread or band is introduced into the pulp or furnish and brought against the wire in such a way as to be embedded in the fibrous structure during sheet forming. This embedding method is commonly known and described e.g. in EP-A1 0 279 880 (Crane) or EP-A1 0 492 407 (GAO).

Occasionally it is desirable for the security element to be embedded in the antifalsification paper in such a way as to be exposed in at least one place on the surface of the antifalsification paper. If the security element has optically variable effects, their action is considerably enhanced, or in many cases made possible at all, by the at least partial exposure of the security element.

One possibility of incorporating such a so-called window safeguarding thread in a document is known from EP-Al 0 059 056 (Portals). The security element is brought against the wire outside the pulp in such a way as to come to lie on raised places applied thereto, called bumps in the following text. At the places where the safeguarding thread lies on the bumps no paper can form on the side facing the wire so that it is freely accessible at exactly these places in the later finished paper.

It is known that the embedding of a safeguarding thread causes difficulties in practice in so far as sheet forming is impeded over and under the thread since the flow rate of the pulp toward the wire is clearly changed or reduced in the area of the thread. This is all the more so the wider the thread to be embedded is. To ensure a sufficiently good sheet quality the method known from EP-A 0 059 056 is therefore limited to threads whose width does not exceed 1 mm to 1.5 mm.

To permit the embedding of wide safeguarding bands as well EP-C 0 070 172 (Portals) proposes embedding the thread by the classical technique described at the outset (wire without bumps) but making special demands on the thread material to be embedded. The filmlike safeguarding band is made to be liquid-permeable in certain periodically recurring areas so that fiber deposit or sheet forming is possible unchanged in these areas during papermaking but sheet forming is prevented in the impermeable areas. During embedding of such a safeguarding band areas thus form in the area of the liquid-impermeable zones in which the band is freely accessible on one side.

Although this method permits very wide bands to be embedded in the paper and made accessible in window areas it proves disadvantageous that the homogeneity of the band is repeatedly interrupted in the longitudinal direction by the periodically recurring perforations. This sacrifices a special advantage of previous window safeguarding threads, namely that the optical effects of the band (negative writing, optically variable properties, etc.) are only testable in the window areas in incident light but the areas embedded in the paper are also recognizable in transmitted light. If the safeguarding thread or band is applied homogeneously in the longitudinal direction it is recognizable as an uninterrupted bar in transmitted light and is thus easy to test. If it has inhomogeneities in the areas embedded in the paper it does not differ very substantially when viewed in incident and transmitted light and is thus difficult to distinguish from applied imitations.

BRIEF SUMMARY OF THE INVENTION

The invention is based on the problem of proposing a security document in which a wide window safeguarding band is embedded, the safeguarding band having a uniform appearance in the document in incident light and transmitted light, and a method for producing it.

An essential aspect is that an antifalsification paper with a window safeguarding thread is formed in the known way but the safeguarding thread is deliberately made so wide that the resulting paper necessarily has flaws in the form of arbitrary or random holes in the area of the safeguarding thread or band. The expert usually attempts to avoid such flaws by all means. In the inventive antifalsification paper these flaws are deliberately accepted and then combined or connected with one or two faultless paper layers in such a way that all flaws are covered by the additional layer(s) or brought in a predefined form.

The invention is based on the surprising finding that when threads or bands of increasing width are incorporated during production of antifalsification papers with window safeguarding threads flaws in the form of holes first arise over the safeguarding band on the side facing away from the wire (the back) as of a certain width of the band. As the width of the band increases further the number and size of these flaws increase without the same flaws occurring on the side of the paper facing the wire (the front) as well. Only after a further increase in width do these flaws occur simultaneously on both sides. If the width of the safeguarding band is increased further there is no sheet forming at all in the area of the safeguarding band on either side of the band in the extreme case.

If one determines experimentally the width of the safeguarding band as of which the flaws occur on the back and the width as of which they additionally occur on the front one has the two limiting values for selecting the inventively usable safeguarding bands in the simplest case.

Experience has shown that the first flaws occur on the back as of a width of about 1.5 to 2 mm. Without additional measures on the cylinder mold machine one can increase the width of the safeguarding band to about 4 to 5 mm (with a customary mesh size of the wire and customary height of the bumps) before flaws occur on the front of the paper as well.

With the inventive solution it is now possible for the first time to use safeguarding threads having a width up to about 4 mm instead of the previous 0.75 to 1 mm, without taking any special additional measures on the cylinder mold machine. By additionally enlarging the mesh size of the wire (which is only possible within narrow limits if the fiber length is unchanged) and changing the height and form of the bumps one can increase the width further without any flaws occurring on the front of the paper.

If even wider safeguarding bands are to be used it is proposed in a development of the invention to provide additional liquid-permeable areas in the edge area of the safeguarding band which are not visible in the finished paper. This measure makes it possible to embed and anchor the band in the edge area even if the impermeable band area is completely exposed. These measures even open up the possibility of embedding safeguarding bands of any desired width in the first paper layer in such a way that they are accessible without interruption from both sides in the center area of the safeguarding band in the extreme case.

If the liquid-permeable edge areas are provided along the safeguarding band on both sides and made sufficiently wide, the safeguarding band is anchored so intensively in the paper layers disposed on both sides that the paper webs can only be detached in the finished paper under a high mechanical load. Such an antifalsification paper can thus fundamentally be used even without any additionally applied paper layers. By applying further paper layers, however, one can additionally stabilize the antifalsification paper and change its appearance further. The second paper layer can also have window areas in the area of the safeguarding band in which the safeguarding band is then accessible unchanged.

By applying additional paper layers on one or both sides with or without window areas one can produce antifalsification paper variants that differ very clearly from previous ones. The particularly wide safeguarding bands give the antifalsification papers a specific appearance that distinguishes them clearly from others and cannot be reproduced even with modern copiers.

The inventive antifalsification paper also has the advantage that the use of substantially wider safeguarding bands makes the latter much easier to test merely due to the greater surface, in particular if windows are simultaneously used. The greater surface also permits more elaborate and complicated printed images and optical effects to be used, which additionally makes it harder to imitate such safeguarding bands. Since such antifalsification papers can also be produced on conventional twin wire paper machines it is possible to utilize the inventive method without any great additional expenditures or investments for manufacturing technology. The use of special safeguarding threads made to be permeable in the edge area furthermore yields completely new possibilities for designing antifalsification papers, since safeguarding bands can now be integrated in a very simple way in the antifalsification paper throughout the length on one or both sides so as to be freely accessible. The accessibility of these bands can also be prevented in case of need on one or both sides by being combined with one or two further paper layers, which can also have congruent or mutually offset windows. By specially arranging such bands in the multiple-copy paper web or by cutting the webs/sheets in the area of the band one can even produce antifalsification papers which are made of transparent film material on one edge and run into the known mottled paper only at a certain edge distance.

DESCRIPTION OF THE DRAWINGS

Further advantages and advantageous developments are the object of the subclaims and will emerge from the description of the invention with reference to the figures, in which:

DETAILED DESCRIPTION OF PREFERRED EMBODIMENTS

Figure 1:
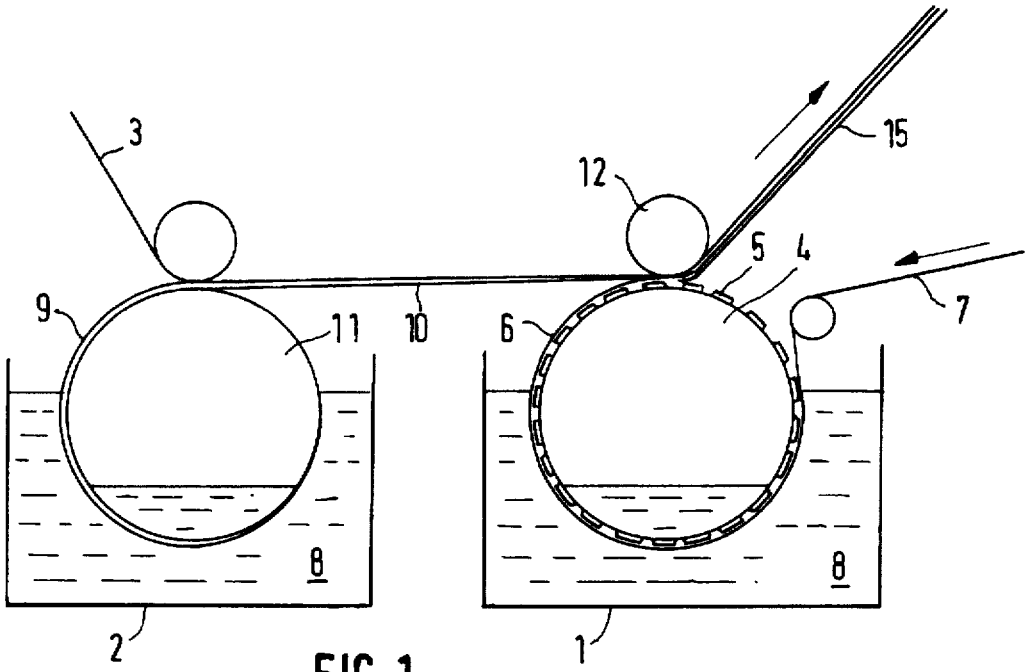
FIG. 1 shows a schematic representation of a twin-wire paper machine for producing an antifalsification paper.

FIG. 1 shows a schematic representation of a twin-wire paper machine as is used for producing antifalsification paper. The machine comprises two cylinder mold paper machines 1 and 2 interconnected by pick-up felt 3.

In paper machine 1 paper web 6 in which safeguarding band 7 is embedded is formed on wire 4. Safeguarding band 7 runs over bump 5 of wire 4 before associated bump 5 or the particular wire area is immersed in pulp or furnish 8 of the paper machine. With paper web 6 produced in this way the safeguarding band is located in an inner plane of the paper. In the areas where it lies on the bumps, however, safeguarding band 7 is freely accessible. The production of such paper webs 6 corresponds to the production method as described for example in EP-C 056 059.

By means of paper machine 2 second paper web 9 is prepared parallel to the production of paper web 6. In the present example paper web 9 is homogeneous, i.e. has no windows or the like. Paper web 9 is removed from wire 11 by means of so-called pick-up felt 10, connected with paper web 6 in the area of contact roll 12 and fed together therewith to further processing units (calender, paper sizing, etc.) of the manufacturing plant.

Figure 2:
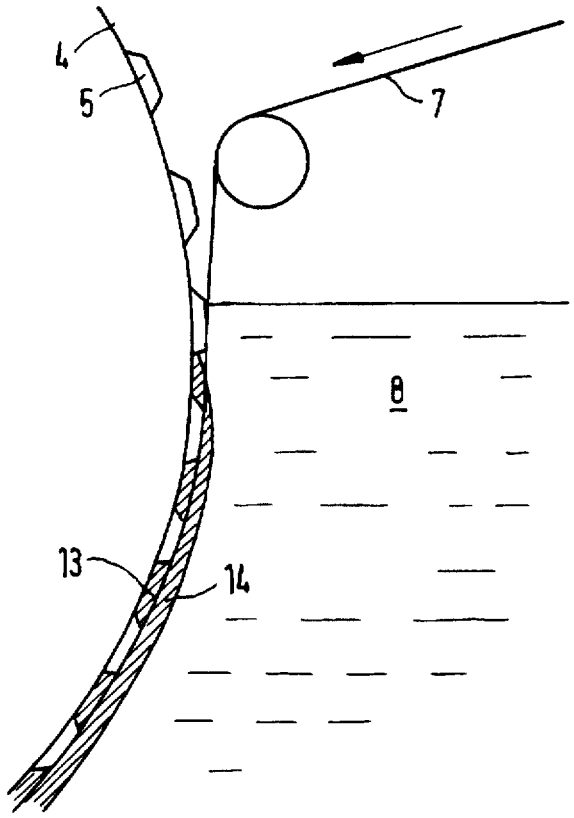
FIG. 2 shows a detail of the wire with bumps for producing window areas in the paper web.

FIG. 2 shows a detail of cylinder mold machine 1 in which the described incorporation of safeguarding band 7 can be detected somewhat more clearly. In particular one can see that no sheet forming is possible in the areas where safeguarding band 7 lies on bump 5 since no fibers can be deposited due to the intimate contact between safeguarding band 7 and bump 5. In the finished paper these contact surfaces form the window areas where the safeguarding band will later be freely accessible. Bumps 5 in wire 4 are usually much wider than the safeguarding band. This permits the safeguarding band to be incorporated within a wide range of tolerance. Depending on the form of bumps 5 and their mutual arrangement in the circumferential track of wire 4 the number and position of window areas in the later paper can be selectively planned.

As mentioned at the outset, sheet forming in the area of the safeguarding thread or band is dependent on the width of the safeguarding band since usually liquid-impermeable band 7 impedes the dewatering through wire 4. The expert is aware that if the safeguarding bands used are too wide flaws in the form of holes can occur which expose the safeguarding band. Since the first flaws are already to be expected at a width of about 1.5 mm safeguarding threads with a maximum width of 1 mm are normally used.

Exact tests have now shown that when the width of the safeguarding thread is increased flaws in the form of holes do not occur simultaneously, as expected, on both sides of the safeguarding band, i.e. side 13 facing wire 4 and side 14 facing away from the wire. Surprisingly enough the flaws appear first on the back of the safeguarding band, i.e. in layer area 14 of the paper web. Only after the width of the safeguarding band is clearly enlarged is the sheet forming influenced in layer area 13 as well so that fortuitous holes arise there in addition to the deliberately produced window areas. If the width of the safeguarding band is increased further the number and size of the holes on both sides of the paper web increases further until sheet forming is finally prevented completely on both sides in the area of the safeguarding band.

In a first embodiment of the invention safeguarding bands are used whose width is selected to be so great that flaws in the form of holes occur on the back of the later antifalsification paper, i.e. in area 14 of safeguarding band 7, but such flaws cannot yet be detected on the front, i.e. in area 13. Such safeguarding bands preferably have a width of 2 mm to 4 mm.

If the faulty back of the thus produced antifalsification paper is covered with paper web 9 produced in the second cylinder mold machine, a minimum paper thickness conveying a homogeneous impression of the paper surface is always present in the area of the flaws as well. The flaws in paper web 6 are thus hidden from the later viewer. The web 9 has a thickness of 10 to 50% , preferably 20%, of the total thickness of the antifalsification paper.

Figure 3:
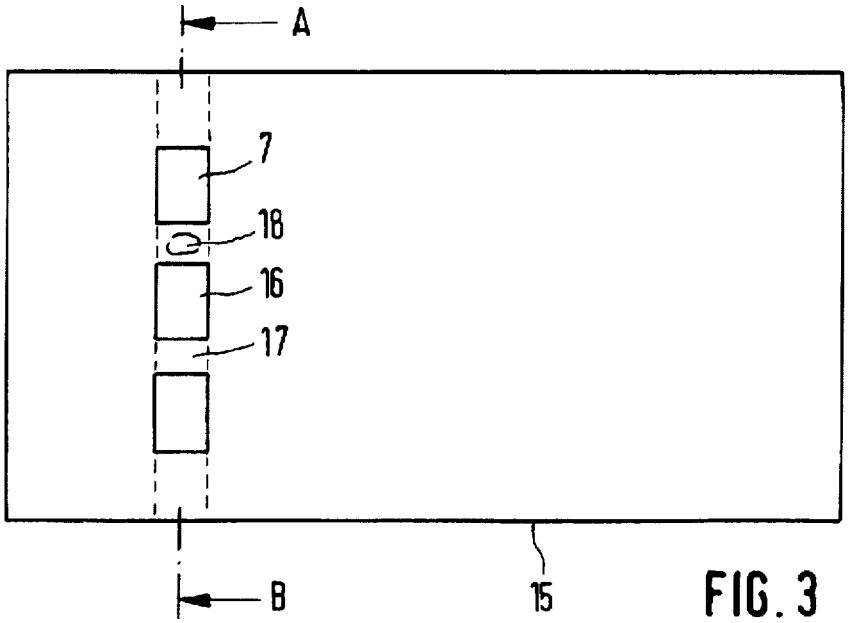
FIGS. 3 to 5 show front and cross-sectional views of an antifalsification paper with a window safeguarding thread.

FIG. 3 shows an antifalsification paper with an embedded window safeguarding band from the front. It has window areas 16 and areas 17 where the antifalsification paper is embedded in the paper or covered by fibers.

Figure 4:
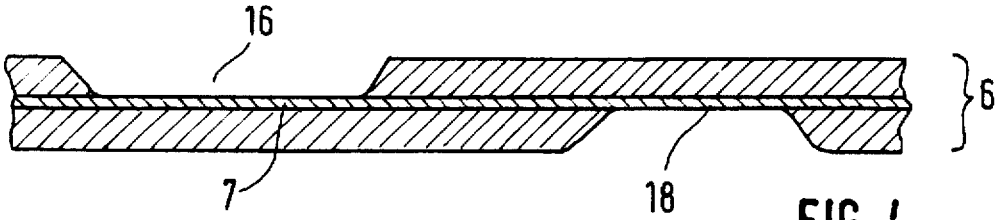

Assuming that the antifalsification paper shown in FIG. 3 is a paper produced by conventional methods in which a safeguarding band with a width of 4 mm was "incorrectly" embedded, this paper has for example in area 18 a flaw opening that exposes the safeguarding band in FIG. 4 similar to window area 16.

Figure 5:
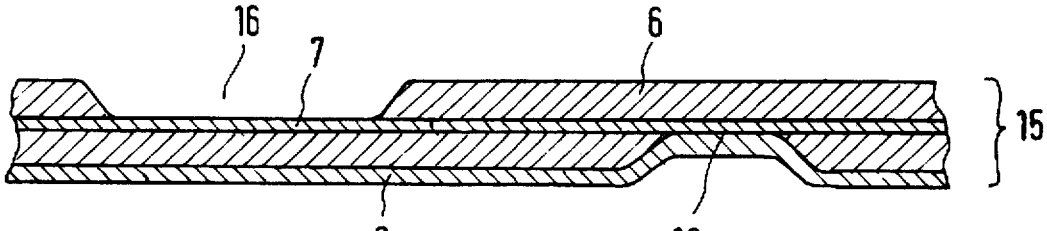

FIG. 5 shows the same section AB of the antifalsification paper except that this antifalsification paper was produced by the inventive method. In this embodiment flaw opening 18 is covered or laminated with additional paper web 9. Although paper web 6 and paper web 9 are shaded differently in FIG. 5 no separate paper layers are ascertainable in the finished paper since two paper webs brought together shortly after sheet forming are interconnected in the following processing steps (calendering, sizing, drying, etc.) so intimately that the individual webs can no longer be separated or distinguished. Superimposition of these two layers thus arouses the impression of a faultlessly produced paper web.

Figure 6:
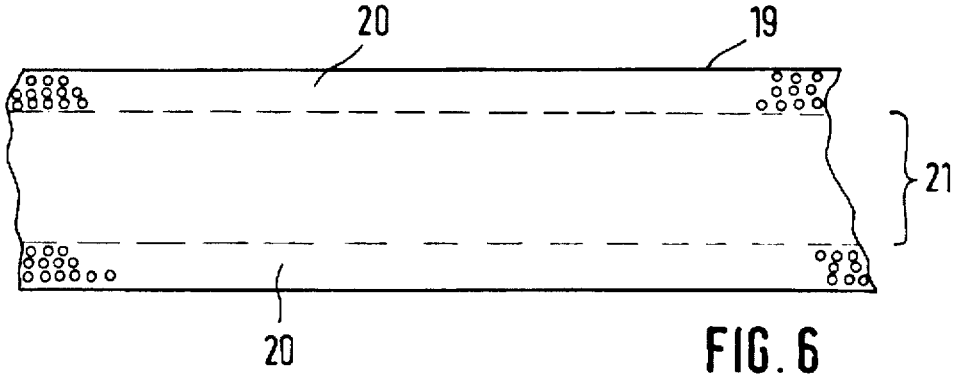
FIG. 6 shows the schematic representation of a safeguarding band with a liquid-permeable edge area.

FIG. 6 shows a special embodiment of safeguarding band 19 which is much wider than the originally defined safeguarding band. Safeguarding band 19 is for example 20 mm or 30 mm wide. It has liquid-permeable and, ideally, even fiber-permeable areas in edge areas 20. In center area 21 band 19 is liquid-impermeable.

Such a safeguarding band 19 can be produced for example from a film strip which was made liquid- or fiber-permeable in the longitudinal edge area by perforation. Alternatively one can use a liquid- or fiber-permeable fabric tape which was made liquid-impermeable in center area 21 by special impregnation or coating.

Figure 7:
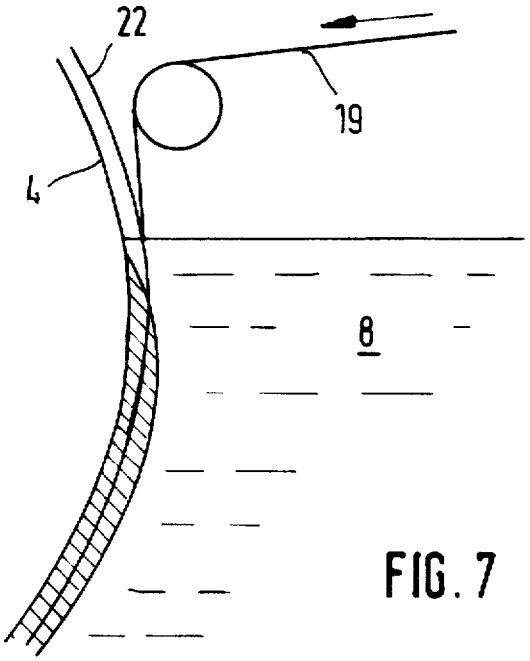
FIG. 7 shows a detail of the wire with a ring-shaped raised area.
Figure 8:
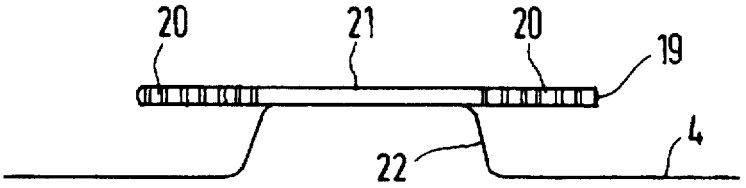
FIG. 8 shows the wire bump of FIG. 7 with a safeguarding band thereon (cross-sectional view)

When such a safeguarding band 19 is made to run, as shown in FIG. 7, over ring-shaped raised area 22 of wire 4, considered in the direction of rotation of the wire, and ring-shaped raised area 22 is made so narrow that permeable edge areas 20 protrude beyond raised area 22 (FIG. 8), the safeguarding band will prevent sheet forming in impermeable area 21 in so far as the latter lies on the ring. In protruding, permeable edge areas 20, however, it is embedded in or integrated with the paper.

Figure 9:
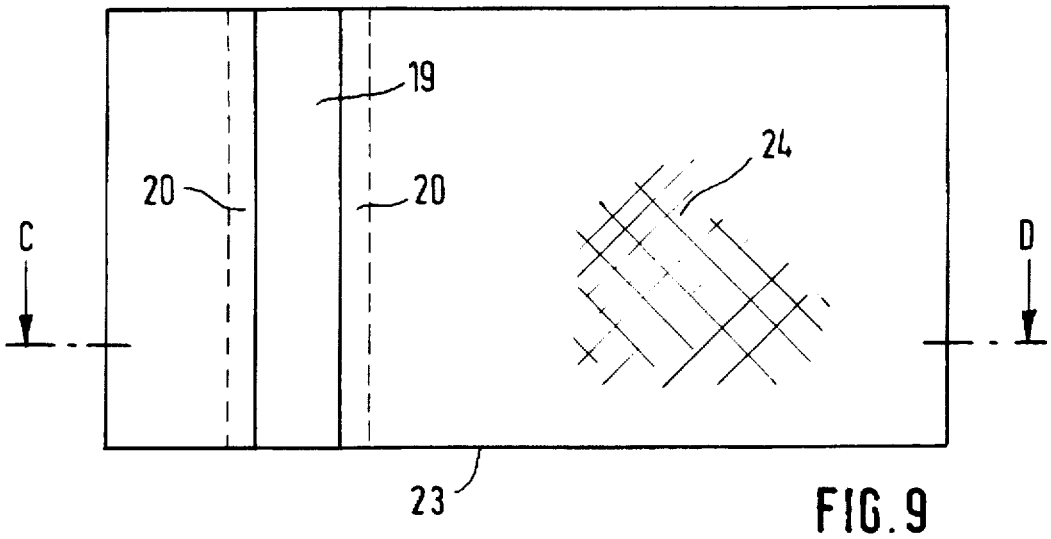
FIG. 9 shows a front view of an antifalsification paper with an uninterrupted window area.
Figure 10:
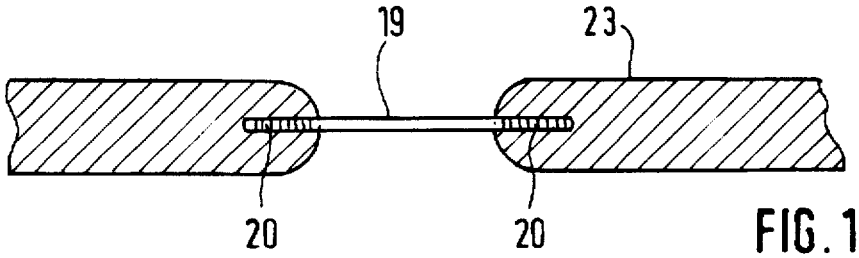
FIGS. 10, 11 show sections CD of the antifalsification paper of FIG. 9.

The result of this procedure is an antifalsification paper in which an extremely wide safeguarding band is embedded that is freely accessible from both sides in center area 21. Edge areas 20 are firmly anchored in the paper due to the permeable structure. Such a paper is shown in FIGS. 9 and 10 from the front and in cross section.

Figure 11:
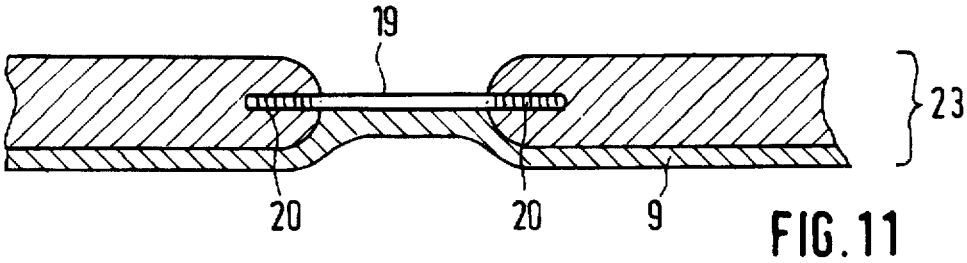

FIG. 11 shows the cross section of such an antifalsification paper in which one side is provided with additional paper layer 9. This gives the antifalsification paper a homogeneous appearance on one side. On this side it can thus be printed all over like conventional antifalsification papers.

On the other side the antifalsification paper is interrupted by safeguarding band 19. If the safeguarding band has holographic or other optically variable effects it seems useful to include these areas in the printed image only in the transitional area. If the safeguarding band only has structures with metallic luster which would each be relatively easy to imitate per se, it is recommendable to provide the security print (steel intaglio printing, guilloche pattern, etc.) over this area as well. This combines or firmly connects the metallic luster of the safeguarding band with the security print.

Figure 12:
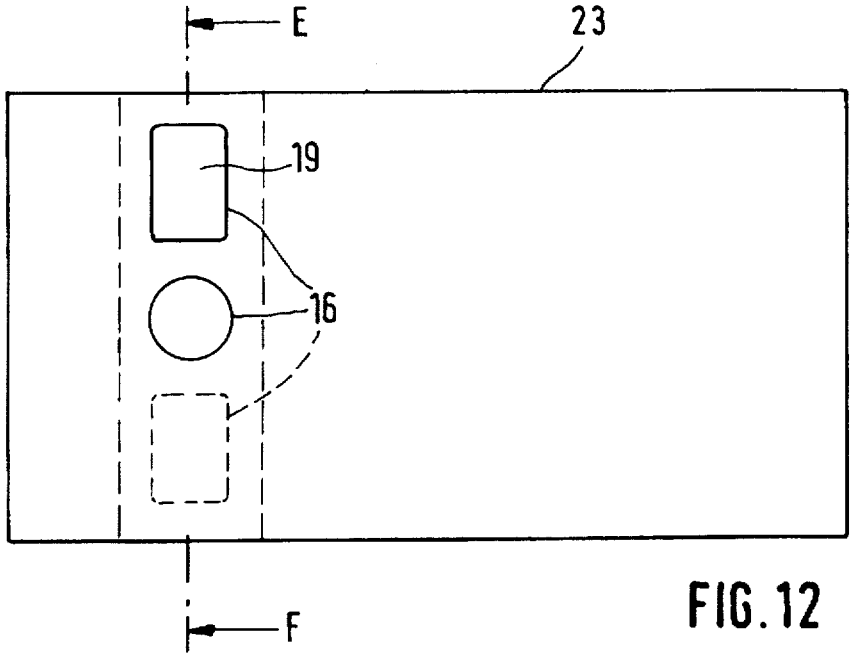
FIG. 12 shows a front view of an antifalsification paper with an embedded safeguarding band and different window variants.
Figure 13:
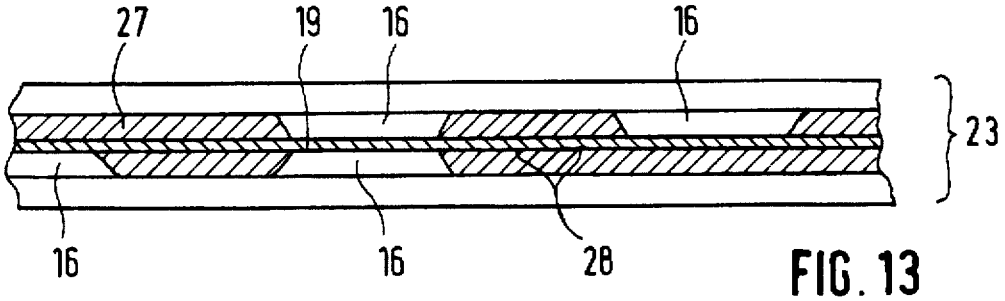
FIG. 13 shows section EF of the antifalsification paper of FIG. 12.

In the embodiments shown in FIGS. 12 and 13 antifalsification paper 23 is connected on each side with further paper layer 27, 28. Outer paper layers 27, 28 have windows 16 in the area of the safeguarding band that are disposed relative to each other such that the safeguarding band is accessible on both sides in one case, through one window only from the front in another case and finally through another window only from the back. A thus produced antifalsification paper can be processed an both sides like customary antifalsification papers. In the relatively large-surface window areas all visually testable properties provided on the safeguarding band are very clearly accessible and thus easy to test by anyone without any optical aids. The window accessible from both sides permits look-through features to be provided, e.g. color layers varying in transmitted and incident light, which increase the resistance to forgery further.

Figure 14:
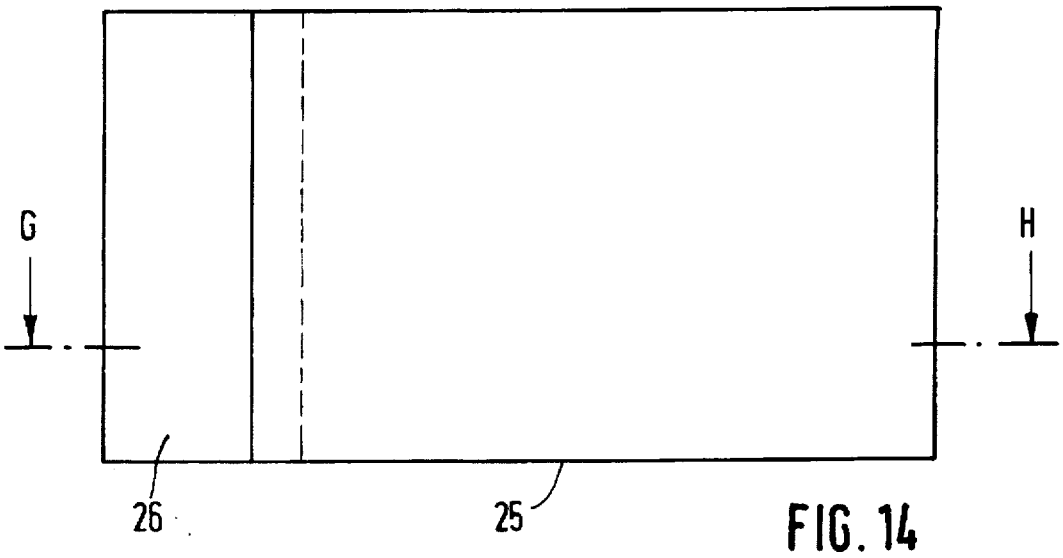
FIG. 14 shows a front view of an antifalsification paper with a transparent edge area.
Figure 15:
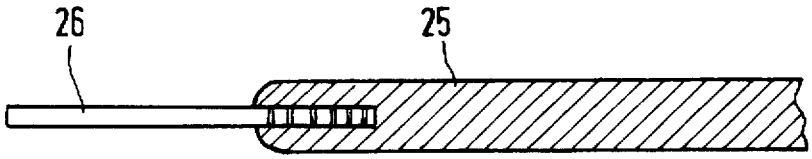
FIG. 15 shows section GH of the antifalsification paper of FIG. 14.

FIGS. 14 and 15 finally show an antifalsification paper 25 in which the safeguarding band 26 is disposed in the edge area. As indicated in particular by section GH, safeguarding band 26 is anchored in the paper only on one side. Such an antifalsification paper can be produced for example by disposing antifalsification paper 25 in the multiple-copy paper web to be produced in such a way that the cutting line for the individual bank note copies extends in the center of the safeguarding band. Alternatively it is also conceivable to provide the safeguarding band in the edge area of the cutting lines during papermaking in such a way that the area of the safeguarding band protruding beyond the cutting edge is removed as a waste strip. This embodiment has the advantage that the width of the film area can be maintained more exactly since the cutting lines can be oriented toward the transition between film and paper, but a disadvantage is that several cuts subject to control mechanisms are necessary.

Furthermore this procedure reduces the useful surface of the paper web due to the unusable strips in the separated edge area.

The expert will appreciate that the stated embodiments are exemplary and that a great number of further embodiments based on the inventive idea are also conceivable.

We claim:

1. A security document comprising first and second paper layers laminated together to form a document having a total thickness and a security band partially imbedded in the first paper layer, said first paper layer including at least one window in one side thereof extending to said security band, said first paper layer including randomly distributed flaw openings located in the side of the first paper layer opposite the side including said at least one window, said flaw openings also extending to and exposing said security band; said second paper layer completely covering the side of said first paper layer containing said openings and having a second layer thickness constituting from 10 to 50% of the document total thickness; said second paper layer extending over and closing said flaw openings to cover said security band in said openings.

2. The security document according to claim 1, wherein said security band is elongated and has a paper furnish permeable longitudinally extending side edge area and an impermeable longitudinally extending central area, said central area being fully exposed over its length in said at least one window.

3. In a method of producing a security document including forming a first paper web from a furnish on a wire mesh and imbedding a security band in the first paper web during formation of the first web in a manner that leaves at least one window in at least one of the surfaces of the first paper web through which the security band is exposed, the improvement comprising:

using a security band have a width greater than 2 mm to thereby create random flaws in the first paper web on the side of the web opposite the side facing the wire mesh, said flaws defining openings in the web exposing one side of the security band; and completely covering the side of said first paper web opposite the wire and covering the flaws and exposed security band with a second paper web.

4. In a method of producing a security document including forming a first paper web layer having first and second opposed surfaces from a furnish using a wire mesh and imbedding an elongated security band in the first paper layer during formation of the first paper layer, the improvement comprising:

using as the security band a security band having a pair of longitudinally extending side edge areas being permeable to paper fibres in the furnish and a longitudinal central portion extending between the side edge areas, said central area being impermeable to the paper fibres to produce an integrated paper to security band connection along the permeable side edge areas of the security band; and providing bumps in the wire mesh and laying the security band directly on the bumps during paper web formation to produce security band exposing windows in the paper web on the side of the web facing the wire mesh, and forming at least a second paper web layer and laminating the second paper web layer to the side of the first paper web layer opposite the bumps.

* * * * *